US007975667B2

(12) United States Patent
Inden

(10) Patent No.: US 7,975,667 B2
(45) Date of Patent: Jul. 12, 2011

(54) CRANKSHAFT-FREE DRIVE SHAFT AND PISTON ASSEMBLY OF A SPLIT-CYCLE FOUR-STROKE ENGINE

(76) Inventor: Michael Inden, Washington Township, CA (US)

( * ) Notice: Subject to any disclaimer, the term of this patent is extended or adjusted under 35 U.S.C. 154(b) by 552 days.

(21) Appl. No.: 12/151,954

(22) Filed: May 12, 2008

(65) Prior Publication Data

US 2009/0277417 A1 Nov. 12, 2009

(51) Int. Cl.
*F02B 75/32* (2006.01)
*F02B 25/00* (2006.01)

(52) U.S. Cl. ..... 123/197.4; 123/68; 123/70 R

(58) Field of Classification Search ..... 123/197.1, 123/197.4, 316, 68, 70 R
See application file for complete search history.

(56) References Cited

U.S. PATENT DOCUMENTS

| | | | | |
|---|---|---|---|---|
| 2,091,413 A | | 8/1937 | Mallory | |
| 2,123,306 A | * | 7/1938 | Hood | 74/570.1 |
| 2,269,948 A | | 1/1942 | Mallory | |
| 5,546,897 A | | 8/1996 | Brackett | |
| 5,623,894 A | | 4/1997 | Clarke | |
| 5,749,262 A | * | 5/1998 | Galvin | 74/44 |
| 6,058,901 A | | 5/2000 | Lee | |
| 6,752,733 B2 | | 6/2004 | Rogers et al. | |
| 6,880,502 B2 | | 4/2005 | Scuderi | |
| 7,017,536 B2 | | 3/2006 | Scuderi | |
| 7,121,236 B2 | | 10/2006 | Scuderi | |
| 7,367,293 B2 | | 5/2008 | Takeuchi | |

FOREIGN PATENT DOCUMENTS

| | | | |
|---|---|---|---|
| DE | 4001776 A | * | 7/1991 |
| EP | 25071 A1 | * | 3/1981 |

* cited by examiner

*Primary Examiner* — Noah Kamen

(57) ABSTRACT

A drive shaft and pistons assembly of a split-cycle four-stroke engine that contains a drive rotary shaft that supports at least two circular eccentrics pivotally connected to the first ends of connecting rods, the other ends of which are pivotally connected to the respective pistons. The circular eccentrics are angularly shifted with respect to each other by an angle optimal from the viewpoint of efficiency of the engine. The invention also provides a method consisting of removably securing the circular eccentrics of the aforementioned engine in different angular positions with respect to each other, testing the performance of the engine, removably mounting the circular eccentrics in a second and subsequently different angular positions with respect to each other, repeating the test of the engine, finding the angular positions of the circular eccentrics that provides the best performance of the split-cycle four-stroke engine, and creating a pre-production prototype of the split-cycle four-stroke engine based on the aforementioned finding.

10 Claims, 7 Drawing Sheets

CRANKSHAFT-FREE DRIVE SHAFT AND PISTON ASSEMBLY OF A SPLIT-CYCLE FOUR-STROKE ENGINE

TECHNICAL FIELD

The present invention relates to internal combustion engines. More specifically, the present invention relates to a split cycle engine—a four-stroke cycle internal combustion engine having a pair of offset pistons in which one piston of a pair is used for the intake and compression stroke and another piston of the pair is used for the power and exhaust stroke, with each four stroke cycle being completed in one revolution of the main shaft. In particular, the invention concerns a drive shaft and piston assembly of a split-cycle four-stroke engine.

BACKGROUND OF THE INVENTION

Internal combustion engines are any of a group of devices in which the reactant of combustion, e.g., oxidizer and fuel, and the products of combustion serve as the working fluids of the engine. The basic components of an internal combustion engine are well known in the art and include the engine block, cylinders, pistons, valve, crankshaft and camshaft. The cylinder heads, cylinders and tops of the pistons typically form combustion chambers into which fuel and oxidizer (e.g. air) are introduced and combustion takes place. Such an engine gains its energy from the heat released during the combustion of the non-reacted working fluids, e.g., the oxidizer-fuel mixture. This process occurs within the engine and is part of the thermodynamic cycle of the device. In all internal combustion engines, useful work is generated from the hot, gaseous products of combustion acting directly on moving surfaces of the engine, such as the top or crown of a piston. Generally, reciprocating motion of the pistons is transferred to rotary motion of a crankshaft via connecting rods.

Internal combustion (IC) engines can be categorized into spark ignition (SI) and compression ignition (CI) categories. SI engines, i.e. typical gasoline engines, use a spark to ignite the air-fuel mixture, while the heat of compression ignites the air-fuel mixture in CI engines, i.e., typically diesel engines.

The most common internal combustion engine is the four-stroke cycle engine, a concept whose basic design has not changed for more than 100 years. This is because of its outstanding performance as a prime mover in the ground transportation industry. In a four-stroke cycle engine, power is recovered from the combustion process in four separate movements (strokes) of a single piston. For purposes herein, a stroke is defined as a complete movement of a piston from a top dead center position to a bottom dead center position or vice versa. Accordingly, a four-stroke cycle engine is defined herein to be an engine, which requires four complete strokes of one or more pistons for every power stroke, i.e. for every stroke that delivers power to a crankshaft.

Many rather exotic early engine designs were patented. Examples of these early patents include U.S. Pat. No. 2,091,413 of 1937 and U.S. Pat. No. 2,269,948 of 1942, both issued to M. Mallory. Various other relatively recent specialized prior art engines have also been designed in an attempt to increase engine efficiency, such as U.S. Pat. No. 5,546,897 issued in 1996 to D. Brackett, U.S. Pat. No. 5,623,894 issued in 1997 to J. Clarke, and U.S. Pat. No. 6,058,901 issued in 2000 to C. L. Lee. However, none were able to offer greater efficiencies or other significant advantages which would replace the standard engine.

Accordingly, there is a need for an improved four-stroke internal combustion engine which can enhance efficiency by more closely aligning the torque and force curves generated during a power stroke without increasing compression ratios substantially beyond normally accepted design limits.

The newcomer in the field of internal combustion engines is a split cycle engine which has been disclosed in a number of patents such as: U.S. Pat. No. 6,880,502 issued in 2005 to C. Scuderi, U.S. Pat. No. 7,017,536 issued in 2006 to C. Scuderi, U.S. Pat. No. 7,121,236 issued in 2006 to C. Scuderi, etc. The same engine has been patented in China, Taiwan, Japan, Korea and Russia. That invention offers advantages and alternatives over the prior art by providing a four-stroke cycle internal combustion engine having a pair of pistons in which one piston of the pair is used for the intake and compression strokes and another piston of the pair is used for the power and exhaust strokes, with each four-stroke cycle being completed in one revolution of the crankshaft. The engine enhances efficiency by more closely aligning the torque and force curves generated during a power stroke without increasing compression ratios.

These and other advantages are accomplished in an exemplary embodiment of the invention by providing a four-stroke split cycle internal combustion engine, which is shown in FIG. 1 in the form of a schematic diagram. The engine 10 comprises a crankshaft 12 journaled for rotation about a crankshaft axis 14 (extending perpendicular to the plane of the paper) of the engine 10. The crankshaft 12 of the engine 10 includes a first throw 16 and a second throw 18. A first connecting rod 20 is pivotally connected to both the first throw 16 of the crankshaft 12 and a power piston 22. The power piston 22 is slidingly received within a first cylinder 24, and being connected to the crankshaft 12, the power piston reciprocates through a power stroke and an exhaust stroke of a four-stroke cycle during a single rotation of the crankshaft. A second connecting rod 26 is pivotally connected to both the second throw 18 of the crankshaft 12 and a compression piston 26. The compression piston 28 is slidingly received within a second cylinder 30, and being connected to the crankshaft, the compression piston reciprocates through an intake stroke and a compression stroke of the same four stroke cycle during the same rotation of the crankshaft. The mechanical linkage of the connecting rods 16 and 18 to the pistons 22, 28 and crankshaft throws 16, 18 serve to convert reciprocating motion of the pistons (as indicated by directional arrow 48 for the power piston 22, and directional arrow 50 for the compression piston 28) to the rotary motion (as indicated by directional arrow 52) of the crankshaft 12. A gas passage 32 interconnects the first and second cylinders. The gas passage includes an inlet valve 34 and an outlet valve 36 defining a pressure chamber therebetween. The inlet valve permits substantially one way flow of compressed gas from the second cylinder to the pressure chamber and the outlet valve permits substantially one way flow of compressed gas from the pressure chamber to the first cylinder.

During operation the power piston 22 leads the compression piston 28 by a phase shift angle 38, defined by the degrees of rotation the crankshaft 12 must rotate after the power piston 22 has reached its top read center position in order for the compression piston 28 to reach its respective top dead center position. The above mentioned patents claim this phase shift angle to be between 20 and 60 degrees. For this particular embodiment the phase shift is fixed substantially at 50 degrees.

Because the compression and power strokes are performed by separate pistons 22 and 28, various enhancements can be made to optimize the efficiency of each stroke without the associated penalties incurred when the strokes are performed by a single piston. For example, the compression piston diameter 46 can be made larger than the power piston diameter 44 to further increase the efficiency of compression. Additionally, the radius 40 of the first throw 20 for the power piston 22 can be made larger than the radius 42 to further enhance the total torque applied to the crankshaft 12. FIG. 1 shows a modification of the embodiment of a split four-stroke engine having these unequal throws and unequal piston diameters. However, the schematics in a series of the aforementioned Scuderi engines, a typical representative of which is one disclosed, e.g., in aforementioned U.S. Pat. No. 6,880,502, depict and describe a crankshaft of a substantially conventional design which will be very difficult and quite expensive to manufacture and remanufacture for development, especially when a number of pairs of cylinders in an engine increases. A value of the power shift angle is not defined precisely in any of the above mentioned patents and is left to be determined during the development of an engine in a range between 20 and 60 degrees. A crankshaft of that kind will substantially increase cost of the development because a new crankshaft will be needed at each and every test. Balancing of that crankshaft will present a challenge as well. On the other hand, in U.S. Pat. No. 7,121,236 a crankshaft of a complicated design is described. It is questionable whether it will perform at a high rate of revolutions.

SUMMARY OF THE INVENTION

It is an object of the present invention to provide an alternative to a conventional crankshaft for a four-stroke split cycle internal combustion engine which is simple in design, less expensive, easier to manufacture and balance.

It is another object of this invention to provide an apparatus which will allow an unrestricted number of cylinders for a four-stroke split cycle internal combustion engine and unrestricted variety of angles for a V-engine.

It is yet another object of this invention to provide an apparatus which allows replacement of journal bearings of a crankshaft by roller and/or needle bearings and as a result reducing heat generation in an engine and thus extending engine life span.

It is yet another object of this invention to provide an apparatus which will be specifically valuable for design and development of a split cycle engine by significantly reducing cost of the development.

In accordance with this invention, there is provided an apparatus for directly converting alternating linear motion to rotary motion. This apparatus is comprised of a rotary shaft for torque transmission having a cross-section that excludes rotation of a plurality of pairs of circular eccentrics indexed on said shaft relative to the shaft. Cylindrical bushings having the same cross-sections as the cross-section of the shaft are provided on the shaft in order to have said shaft mounted rotationally in an engine block. A first connecting rod is pivotally connected to both the first circular eccentric of a pair on the shaft at one end and a power piston of an engine at its top distal end. A second connecting rod is pivotally connected to both the second circular eccentric of the pair on the shaft at one end and a compression piston of an engine at its top distal end.

DETAILED DESCRIPTION OF THE PREFERRED EMBODIMENTS

Figure 2:
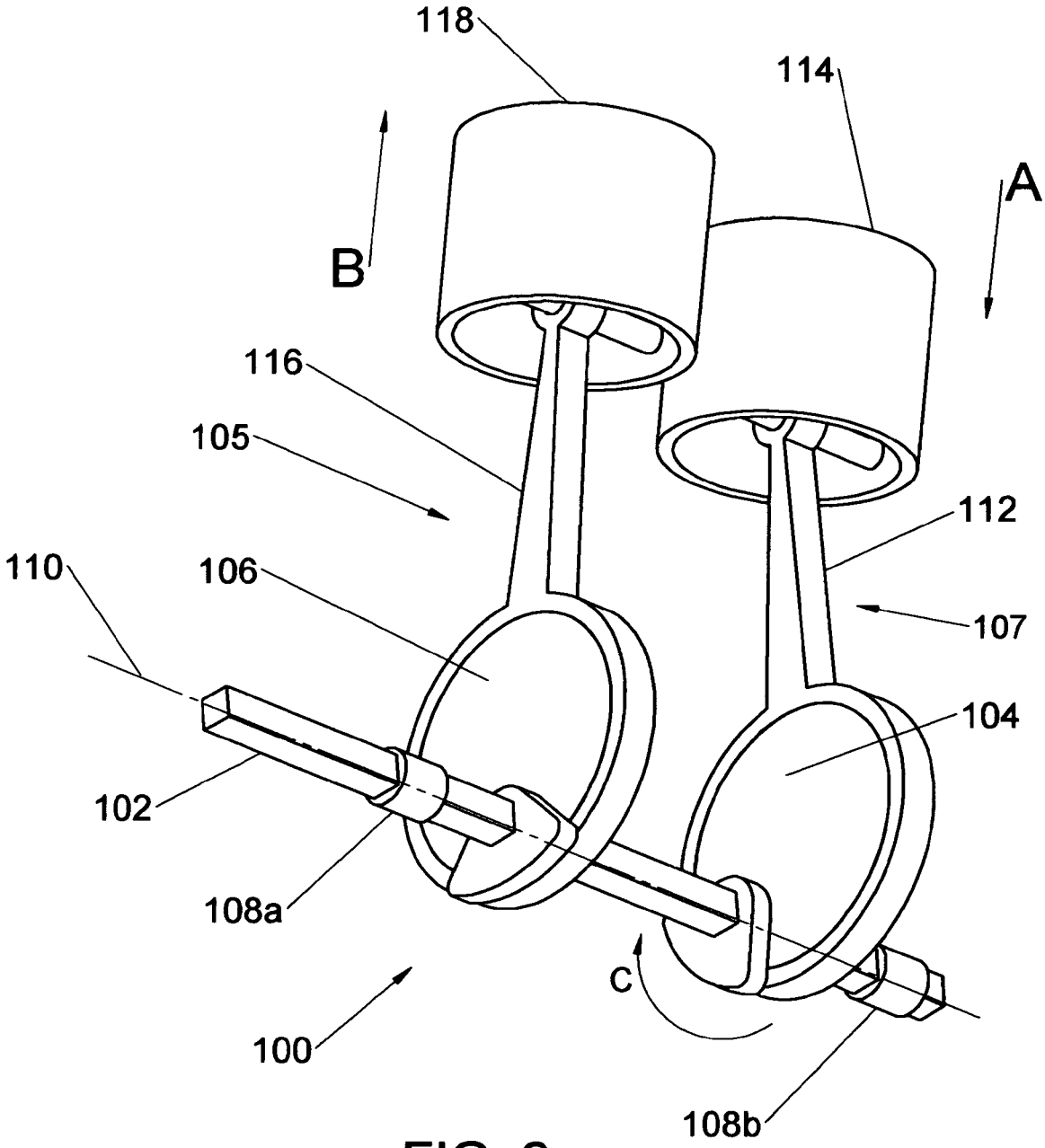
FIG. 2 is a schematic diagram of an exemplary embodiment of the apparatus of present invention.
Figure 3:
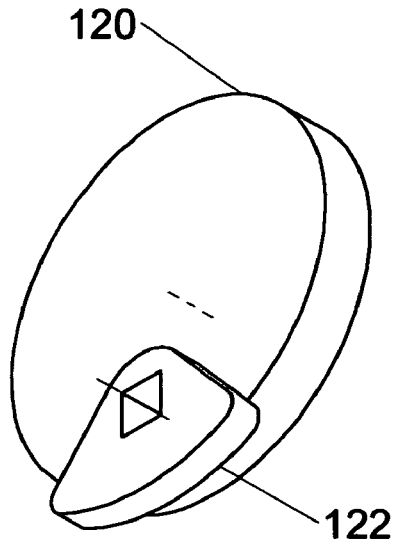
FIG. 3 is a schematic diagram of an exemplary embodiment of a circular eccentric of the present invention.

Referring to FIG. 2, a schematic diagram of exemplary embodiment of an apparatus to replace a crankshaft in a split cycle four-stroke internal combustion engine in accordance with the present invention, is shown in three-dimensional view generally at 100 (for simplicity of the drawing and description the cylinder block of an engine and other engine components are not shown). The proposed apparatus 100 is a drive shaft and piston assembly that comprises a rotary drive shaft 102 (hereinafter referred to merely as "a shaft") of a square cross-section which includes a first circular eccentric 104 mounted in its first indexed position, a second circular eccentric 106 mounted in its second indexed position, and a pair of integrally mounted cylindrical bushings 108*a* and 108*b*. The crankshaft 102 is journaled at the bushings 108*a* and 108*b* for rotation about a shaft axis 110. A first connecting rod 112 is pivotally connected to both the first circular eccentric 104 of the shaft 102 and a power piston 114 at its top distal end. A second connecting rod 116 is pivotally connected to both the second circular eccentric 106 of the shaft 102 and a compression piston 118 at its top distal end. The mechanical linkages of the connecting rods 112, 116 to the pistons 114, 118 and the circular eccentrics 104,106 which are indexed on the shaft 102 serve to convert the reciprocating motion of the pistons (as indicated by directional arrow A for the power piston 114, and directional arrow B for the compression piston 118) to the rotational motion (as indicated by directional arrow C) of the shaft 102. Each circular eccentric comprises a circular disk 120 and a counterweight 122 as illustrated in FIG. 3, which is a schematic diagram of an exemplary embodiment of a circular eccentric of the present invention. The counterweight 122 provides means to balance the system in order to tune an engine to run smoothly by reducing vibration and other stresses. The cylindrical bushings 108*a* and

Figure 7:
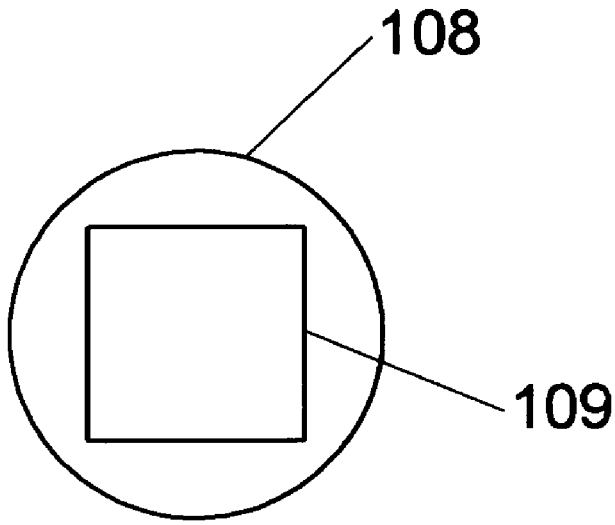
FIG. 7 is a schematic diagram of an exemplary embodiment of a bushing of the present invention.

108*b* have a coaxial opening of substantially the same cross-section 109 as a cross-section of the shaft 102 of FIG. 2 as shown in FIG. 7, which is a schematic diagram of an exemplary embodiment of a bushing of the present invention.

Figure 4:
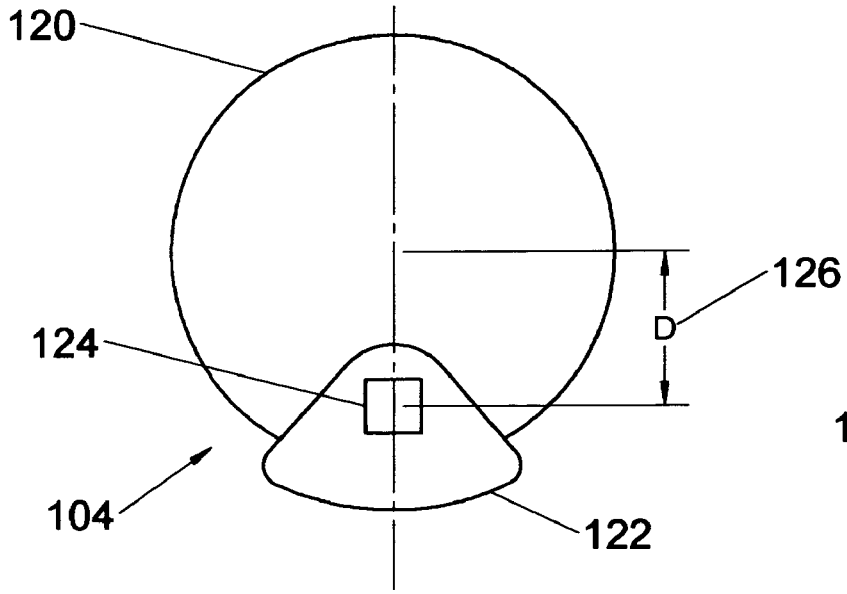
FIG. 4 is a schematic diagram of an exemplary embodiment of a circular eccentric for a power piston of the present invention.

The first circular eccentric 104 illustrated in FIG. 4, is a schematic diagram of an exemplary embodiment of a circular eccentric for a power piston of the present invention has an opening 124 of substantially the same cross-section as a cross-section of the shaft 102, positioned at a distance "D" 126 from the center of the circular disk 120. This distance corresponds to an effective crankshaft radius of dimension "D".

Figure 1:
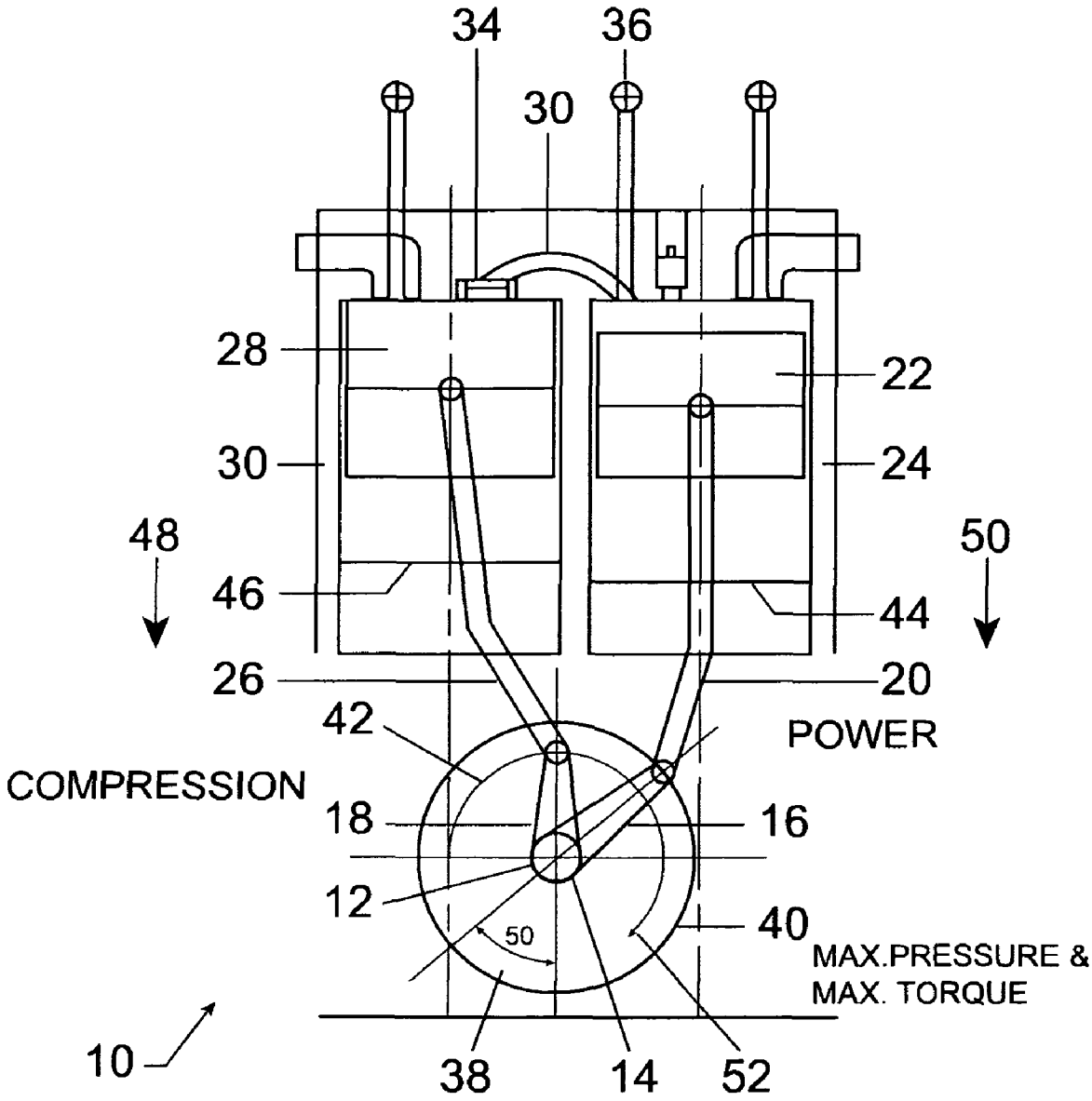
FIG. 1 is a schematic diagram of a representative prior art split cycle engine having unequal throws and pistons.
Figure 5:
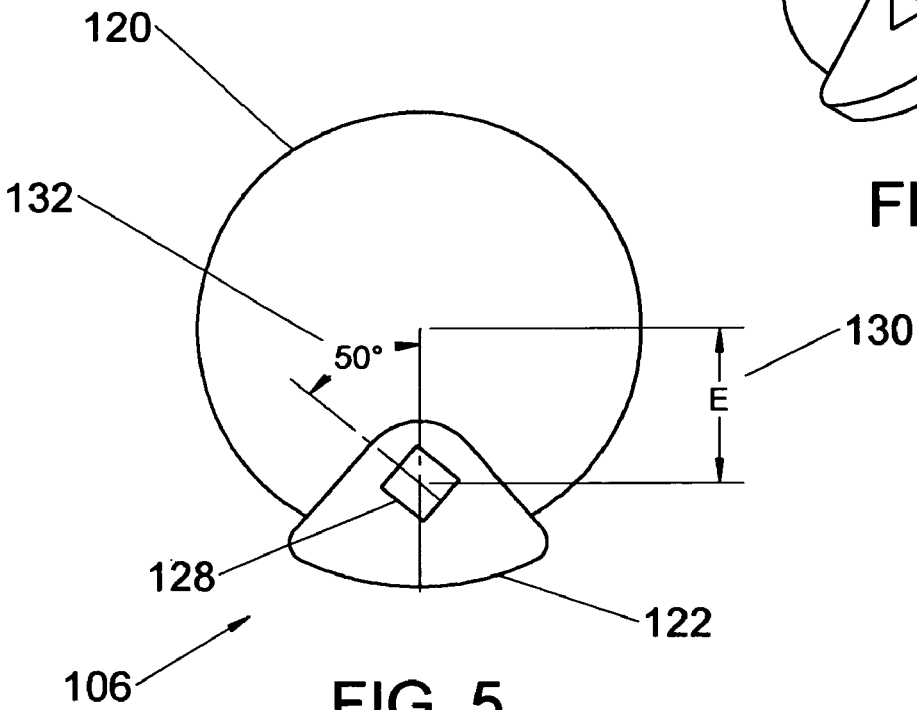
FIG. 5 is a schematic diagram of an exemplary embodiment of a circular eccentric for a compression piston of the present invention.

The second circular eccentric 106 illustrated in FIG. 5, which is a schematic diagram of an exemplary embodiment of a circular eccentric for a compression piston of the present invention, has an opening 128 of substantially the same cross-section as a cross-section of the shaft 102, positioned at a distance "E" 130 from the center of the circular disk 120. This distance corresponds to an effective crankshaft radius of dimension "E". The opening 128 is turned at an angle 132 with respect to the position of the opening 124 of the first circular eccentric 104 of FIG. 4. This angle corresponds to the phase shift angle 38 of FIG. 1 and for this particular embodiment the phase shift is fixed substantially at 50 degrees. By replacing just one component for a pair of cylinders in the proposed system 100—the second circular eccentric 106, with a similar circular eccentric having the opening 128 at a different angle, the phase shift angle 38 can be easily changed.

The distances "D" 126 of FIG. 4 and "E" 130 of FIG. 5 can be the same or they can differ. And again by replacing just the same one component for a pair of cylinders in the proposed system 100—the second circular eccentric 106, with a similar circular eccentric having the opening 128 at a different distance "B" 130, an effective crankshaft radius can be easily changed.

The mechanical linkage of the connecting rods 112 and 116 to the pistons 114, 118 and to the circular eccentrics 104, 106 which are integrally mounted on the shaft 102, serves to convert reciprocating motion of the pistons 114 and 118 to the rotary motion of the shaft 102.

Though this embodiment of the invention shows cross-sections of the shaft 102 and openings 124 and 128 of the circular eccentrics 104 and 106 as substantially square, it is within the scope of this invention that other cross-sections may also be employed such as other polygons with different numbers of sides, ellipse or others which will assure indexed positions of the circular eccentrics 104 and 106 on the shaft 102.

Figure 6:
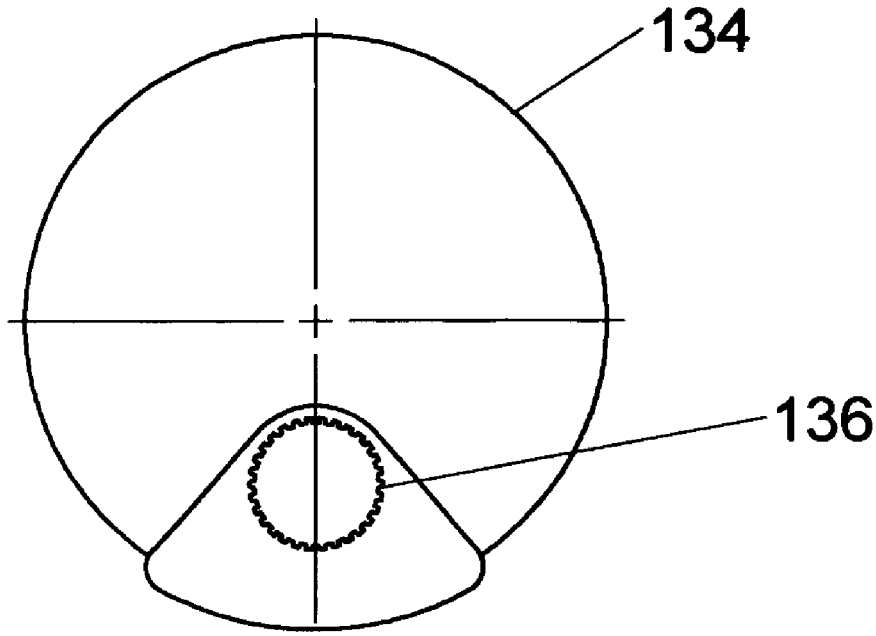
FIG. 6 is a schematic diagram of an embodiment of a circular eccentric with an alternative opening for mounting on the shaft.

In an alternative exemplary modification of the invention the shaft 102 of the invention can be a spline shaft which will accept a circular eccentric 134 as shown in FIG. 6, which is a schematic diagram of an embodiment of a circular eccentric with an alternative opening for mounting on the shaft. A mounting opening 136 of the eccentric 134 has a cross-section to match the spline shaft. This exemplary modification should have the particular advantage to finalize the development of the split cycle engine because a single eccentric can be used in several tests to optimize the phase shift angle 38.

Figure 8:
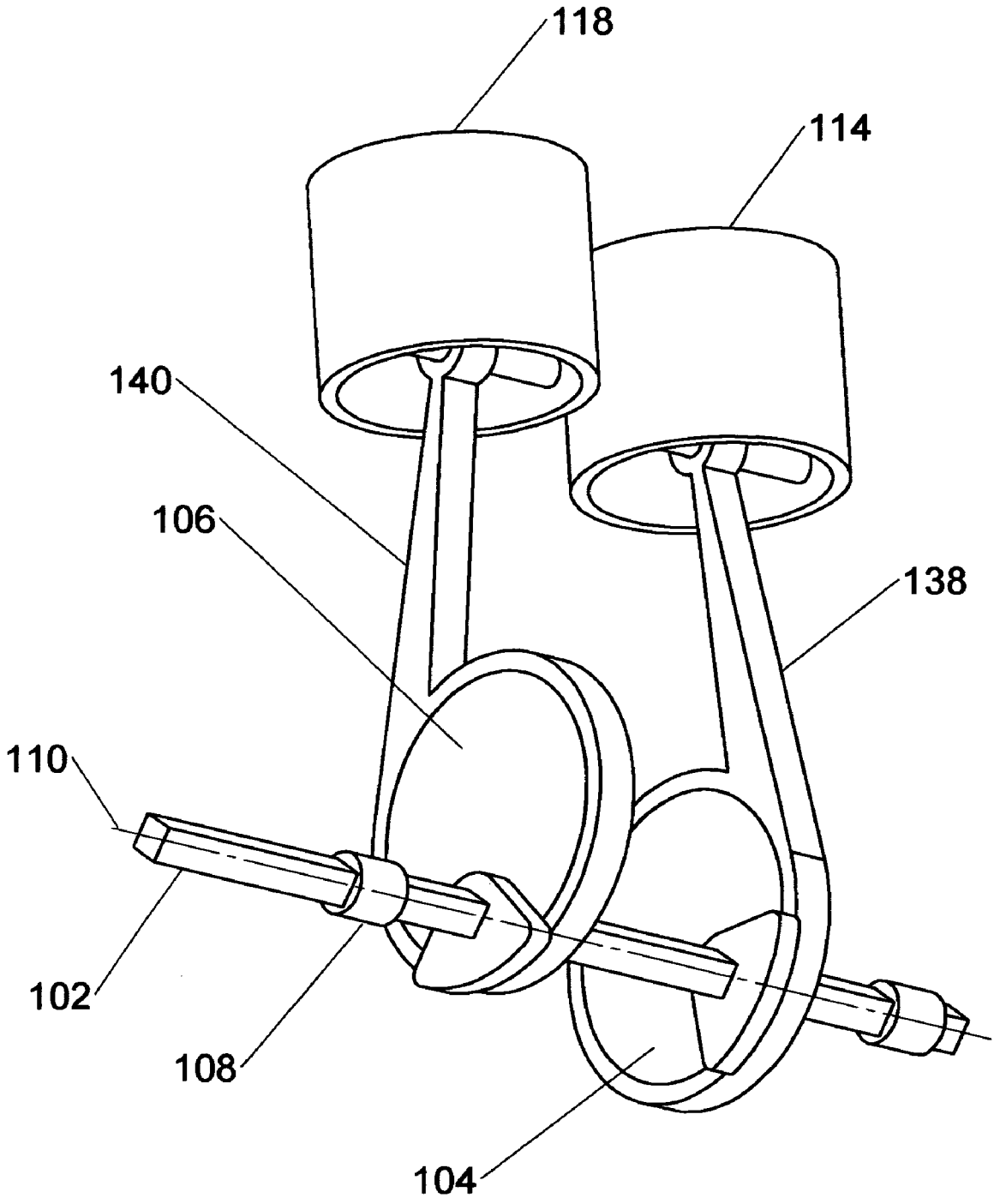
FIG. 8 is a schematic diagram of an exemplary embodiment of the present invention with alternative embodiment of the connecting rods.

Another exemplary modification of the invention illustrates in FIG. 8, connecting rod 138 and 140 positioned tangentially to the circular eccentric 106 in order to maximize torque applied to the shaft 102 during a power stroke and apply maximum torque to the compression piston 118 during the compression stroke.

Figure 9:
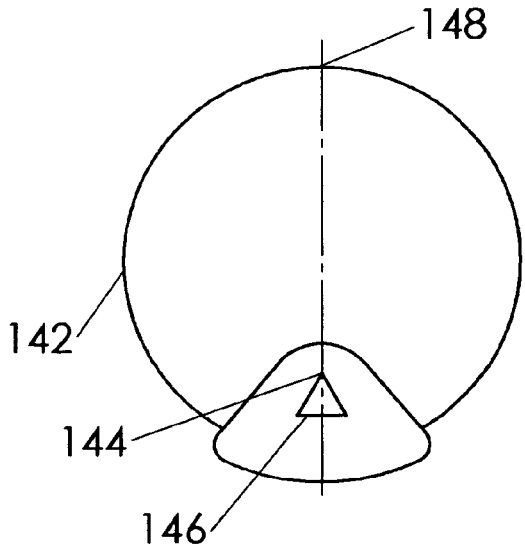
FIG. 9 is a schematic diagram of an exemplary embodiment of a circular eccentric for the first power piston of an inline engine of the present invention.
Figure 10:
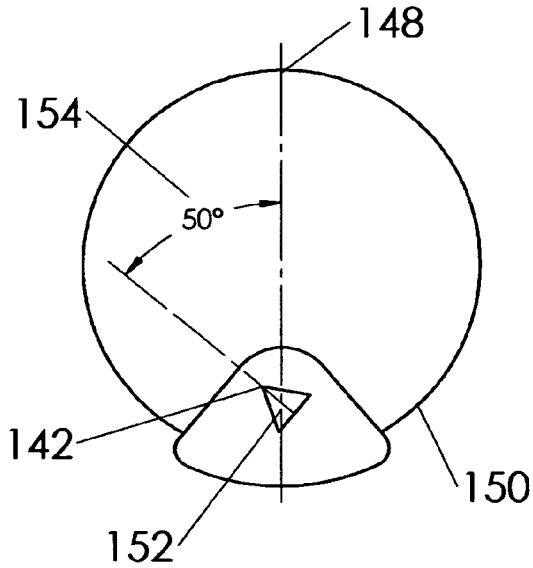
FIG. 10 is a schematic diagram of an exemplary embodiment of a circular eccentric for the first compression piston of an inline engine of the present invention.
Figure 11:
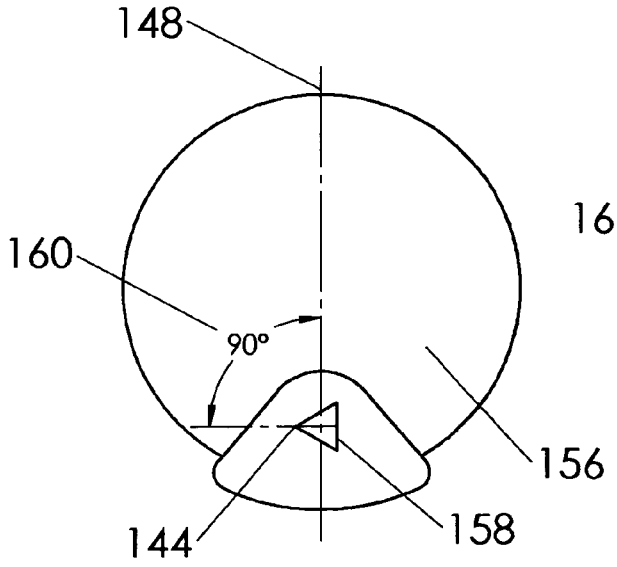
FIG. 11 is a schematic diagram of an exemplary embodiment of a circular eccentric for the second power piston of an inline engine of the present invention.
Figure 12:
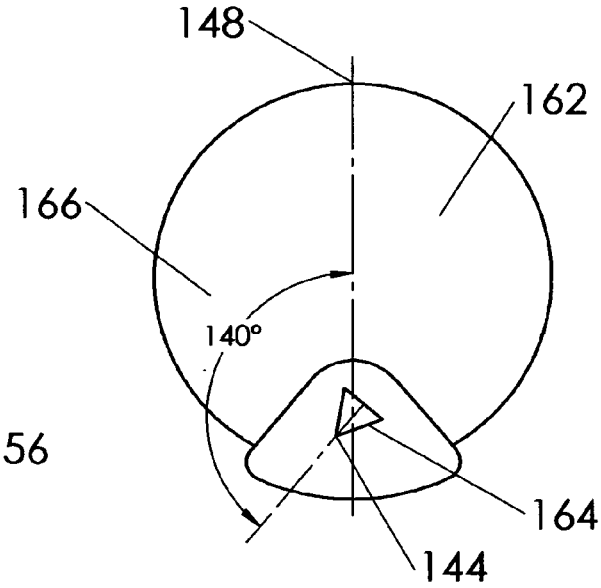
FIG. 12 is a schematic diagram of an exemplary embodiment of a circular eccentric for the second compression piston of an inline engine of the present invention.

FIGS. 9 through 12, which are schematic diagrams of an exemplary embodiment of two pairs of circular eccentrics, illustrate how orientation of openings for mounting circular eccentrics on a shaft changes when more pairs of cylinders are added to an engine. For illustration purposes, it is assumed that four cylinders of a straight—inline conventional internal combustion engine are replaced by those pairs. Also, to clarify the illustration, openings of a triangular cross-section are depicted. FIG. 9 illustrates the first circular eccentric 142 which will be connected to the power piston of the first pair. An apex 144 of a triangular mounting opening 146 is aligned substantially vertically with an apogee 148 of the first circular eccentric 142. FIG. 10 illustrates the second circular eccentric 150 which will be connected to the compression piston of this pair. A triangular mounting opening 152 is turned in such a way that its apex 144 comprises an angle 154 with the apogee 148 of the second circular eccentric 150. This angle 154 is the phase shift angle and for this particular embodiment it is fixed substantially at 50 degrees. FIG. 11 illustrates the first circular eccentric 156 which will be connected to the power piston of the second pair. A triangular mounting opening 158 is turned in such a way that the apex 144 comprises an angle 160 with the apogee 148 of the second circular eccentric 156. In a split four-stroke cycle engine, each of four stroke cycles is completed in one revolution of a shaft, hence the next power cycle should start at an angle equal to 360 degree divided by the number of pairs in an engine. This angle, defined by the degrees of rotation a shaft must rotate from the start of one power stroke to the start of the next power stroke, should be called a cycle angle. For this particular embodiment it results with the cycle angle substantially at 90 degrees. FIG. 12 illustrates the second circular eccentric 162 which will be connected to the compression piston of this pair. A triangular mounting opening 164 is turned in such a way that its apex 144 comprises an angle 166 with the apogee 148 of the second circular eccentric 160. This angle 164 is equal to a sum of the cycle angle and the phase shift angle and for this particular embodiment it is fixed substantially at 140 degrees. Positioning of the rest of the pairs follows the given pattern.

In fact, the openings 124 (FIG. 4), 128 (FIG. 5), 136 (FIG. 6), 146 (FIG. 9), 152 (FIGS. 10), and 164 (FIG. 12) are indexing openings, which are used for mounting the circular eccentrics such as eccentrics 104 and 106 (FIG. 2), 120 (FIG. 4), 134 (FIG. 6), 142 (FIG. 9). 156 (FIG. 11), and 166 (FIG. 12) on the aforementioned rotary drive shaft 102 in a plurality of different angular positions with respect to each other in the range of cycle/phase angles. The aforementioned indexing openings 124 (FIG. 4), 128 (FIG. 5), 136 (FIG. 6), 146 (FIG. 9), 152 (FIG. 10), and 164 (FIG. 12) have cross-sections that exclude rotation of the eccentrics relative to the rotary drive shaft 102.

Figure 13:
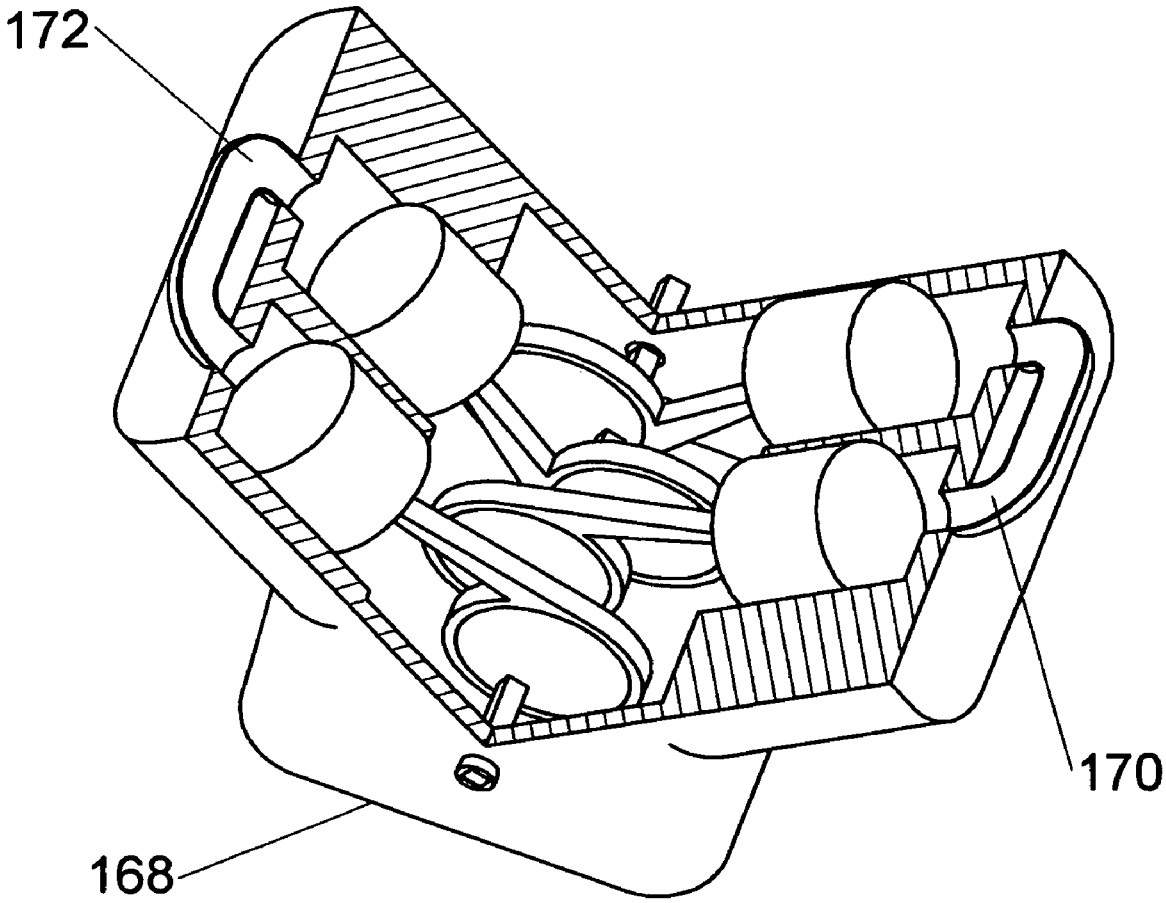
FIG. 13 is a schematic diagram of an exemplary embodiment of a V-engine of the present invention.

For illustration purposes, only an exemplary embodiment of the above two pairs of cylinders placed in a V-block 168 of an engine is shown generally in FIG. 13. Each pair of the cylinders is placed side by side on one of the sides of the V-block 168. Gas passage 170 and 172 interconnect the first and second cylinders. The value of an angle of the V-block does not have specific restriction and can be taken into account in calculations of the cycle angle by one skilled in the art.

In other words, the aforementioned drive shaft and piston assembly 100 (FIG. 2) comprises at least one pair of sub-assemblies, each pair comprising a first sub-assembly 105 and a second sub-assembly 107, wherein each sub-assembly is comprised of a circular eccentric, such as the eccentrics 104 and 106 mounted on the rotary drive shaft 102, the pistons 114 and 118, and connecting rods 112 and 116 pivotally connected to the eccentrics 104, 106 and to the pistons 114, 118.

The eccentrics 104 and 106 are angularly shifted with respect to each other on the aforementioned rotary drive shaft 102 at a phase angle (FIG. 2).

A method of the invention consists of optimization of a phase angle in a split-cycle four-stroke engine of the type shown in FIG. 13. The method consists of providing the above-described drive shaft and piston assembly 100 composed of a drive shaft 102 and a pair of the aforementioned sub-assemblies that contain respective eccentrics, pistons, and connecting rods, mounting the circular eccentrics 104 and 106 (FIG. 2) on the rotary drive shaft 102 in a plurality of first angular positions with respect to each other by means of indexing openings 124 (FIG. 4), 128 (FIG. 5), 136 (FIG. 6), 146 (FIG. 9), 152 (FIG. 10), and 164 (FIG. 12) in the range of cycle/phase angles, and then testing the performance of the split-cycle four-stroke engine. Following this, the eccentrics are removed from the rotary drive shaft 102 and are mounted in a second indexing position with subsequent repetition of the test procedure. The above steps of removing and repositioning of the eccentrics in different position is repeated several times, and then the angular position of the eccentrics that provides the best performance of the split-cycle four-stroke engine is determined, and a pre-production prototype of the split-cycle four-stroke engine based on the aforementioned finding is created.

During the operation, the power piston 112 leading the compression piston 118 by the phase shift angle 38 moves linearly in the directions of arrow A and converts its reciprocating motion to the rotational motion of the circular eccentric 104 (as indicated by directional arrow C) which results in rotation of the shaft 102. As shaft 102 rotates in the direction of arrow C it turns the circular eccentric 106 which translates into leaner reciprocating movements of the compression piston 118.

Thus it has been shown that the apparatus of the invention performs its functions substantially in the same way as a conventional crankshaft type. In other words, the apparatus of the invention provides an alternative to a conventional crankshaft for a four-stroke split cycle internal combustion engine which is simple in design, less expensive, easier to manufacture and balance. This apparatus will allow unrestricted number of cylinders for a four-stroke split cycle internal combustion engine and unrestricted variety of angles for a V-engine. The apparatus allows replacement of journal bearings of a crankshaft by roller and/or needle bearings and as a result reducing heat generation in an engine and thus extending engine life span. It will be specifically beneficial for the design and development of a split cycle engine by significantly reducing cost of the development.

While preferred embodiments have been shown and described, various modifications and substitutions may be made thereto without departing from the spirit and scope of the invention. For example, though this embodiment describes a shaft as having a polygon or elliptical cross-section for indexing the circular eccentrics, one skilled in the art would recognize that there might be other means to index the eccentrics on the shaft as well. One skilled in the art would also recognize that more than a pair of bushings, which shown and described, can be employed on the shaft. Even though this embodiment describes the apparatus as applied for a split cycle four-stroke internal combustion engine, one skilled in the art would recognize that conventional four-stroke internal combustion engines, compression ignition engines, compressors etc. are within the scope of this invention also. Accordingly, it is to be understood that the present invention has been described by way of illustration and not limitation.

The invention claimed is:

1. A drive shaft and piston assembly of a split-cycle four-stroke engine comprising:

a rotary drive shaft;

a plurality of circular eccentrics mounted on the aforementioned rotary drive shaft by means of indexing openings;

a plurality of pistons the number of which corresponds to the number of the circular eccentrics;

and connecting rods the number of which corresponds to the number of circular eccentrics and pistons, the connecting rods having one ends and other ends, the aforementioned one ends being pivotally connected to the respective circular eccentrics, and the aforementioned other ends being pivotally connected to the respective pistons, wherein the circular eccentrics being angularly shifted with respect to each other on the aforementioned rotary drive shaft at a phase angle that is in the range of 5° to 60°, and wherein the aforementioned indexing openings have means for changing angular positions of the circular eccentrics with respect to each other on the rotary drive shaft in the range of the aforementioned phase angle.

2. The drive shaft and piston assembly of claim 1, wherein the indexing openings have cross-sections that exclude rotation of the circular eccentrics relative to the rotary drive shaft.

3. The drive shaft and piston assembly of claim 1, wherein the aforementioned assembly comprises at least one pair of sub-assemblies, each pair comprising a first sub-assembly and a second sub-assembly, each sub-assembly comprising a circular eccentric mounted on the rotary drive shaft, a piston, and a connecting rod pivotally connected to the circular eccentric and to the piston.

4. The drive shaft and piston assembly of claim 3, wherein the piston of the first sub-assembly of the aforementioned pair is a power piston and the piston of the second sub-assembly of the aforementioned pair is a compression piston.

5. The drive shaft and piston assembly of claim 1, wherein each circular eccentric is provided with a counterweight for balancing the assembly in order to tune an engine by reducing vibration and stress.

6. A method of optimization of a phase angle in a split-cycle four-stroke engine comprising the steps of:

providing a rotary drive shaft and a plurality of circular eccentrics;

removably mounting the circular eccentrics on the rotary drive shaft in a plurality of the first angular positions with respect to each other by means of indexing openings in the range of a phase angle;

testing the performance of the split-cycle four-stroke engine;

removing the circular eccentrics from the rotary drive shaft;

removably mounting the circular eccentrics in a second angular position with respect to each other which are different from the first angular positions;

testing the performance of the split-cycle four-stroke engine;

repeating the steps of removing, removably mounting, and testing a plurality of times; and finding the angular positions of the circular eccentrics which provide the best performance of the split-cycle four-stroke engine; and creating a pre-production prototype of the split-cycle four-stroke engine based on the aforementioned finding.

7. The method of claim 6, wherein the phase angle is in the range of 5° to 60°.

8. The method of claim 7, wherein the aforementioned indexing openings have means for changing angular positions of the eccentrics with respect to each other on the rotary drive shaft in the range of the aforementioned phase angle.

9. The method of claim 6, further comprising a step of balancing the assembly in order to tune an engine by providing each circular eccentric with a counterweight.

10. The method of claim 8, further comprising a step of balancing the assembly in order to tune an engine by providing each circular eccentric with a counterweight.

* * * * *